US011410626B1

(12) United States Patent
Han et al.

(10) Patent No.: US 11,410,626 B1
(45) Date of Patent: Aug. 9, 2022

(54) METHOD FOR DRIVING DISPLAY PANEL, DISPLAY PANEL AND DISPLAY DEVICE

(71) Applicants: Beijing BOE Optoelectronics Technology Co., Ltd., Beijing (CN); BOE TECHNOLOGY GROUP CO., LTD., Beijing (CN)

(72) Inventors: Wenchao Han, Beijing (CN); Wei Sun, Beijing (CN)

(73) Assignees: Beijing BOE Optoelectronics Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/511,704

(22) Filed: Oct. 27, 2021

(30) Foreign Application Priority Data

Jan. 19, 2021 (CN) ..... 202110068236.9

(51) Int. Cl.
*G09G 3/36* (2006.01)
*G09G 3/20* (2006.01)

(52) U.S. Cl.
CPC ..... *G09G 3/3685* (2013.01); *G09G 3/2074* (2013.01); *G09G 2310/0291* (2013.01); *G09G 2310/0297* (2013.01); *G09G 2310/08* (2013.01); *G09G 2320/0223* (2013.01); *G09G 2320/0233* (2013.01); *G09G 2320/0285* (2013.01); *G09G 2360/16* (2013.01)

(58) Field of Classification Search
CPC ..... G09G 3/2074; G09G 3/3685; G09G 2310/0291; G09G 2310/0297; G09G 2310/08; G09G 2320/0223; G09G 2320/0233; G09G 2320/0285; G09G 2360/16
See application file for complete search history.

(56) References Cited

U.S. PATENT DOCUMENTS 8,872,989 B2 * 10/2014 Tokumura ..... G09G 3/3648 349/15
8,922,602 B2 * 12/2014 Choi ..... G09G 3/3648 345/694

(Continued)

*Primary Examiner* — Gene W Lee
(74) *Attorney, Agent, or Firm* — Houtteman Law LLC

(57) ABSTRACT

The present application provides a method for driving a display panel, including: providing data signals to M rows of sub-pixels, wherein providing data signals to an X-th row of sub-pixels includes: determining, for each sub-pixel in the X-th row, a grayscale compensation value for a data signal provided to the sub-pixel; determining, for each sub-pixel, an actual grayscale corresponding to the sub-pixel according to the grayscale compensation value and a theoretical grayscale value $L_x$ of the sub-pixel; and providing the data signals to the X-th row of sub-pixels according to the actual grayscales corresponding to the respective sub-pixels in the X-th row. The grayscale compensation value is determined by: calculating a grayscale difference $\delta$ by a formula $\delta=L_x-L_{x-1}$, where grayscale $L_{x-1}$ is a theoretical grayscale of an adjacent sub-pixel in an (X−1)-th row; and determining the grayscale compensation value according to the grayscale difference and a grayscale compensation look-up table.

19 Claims, 8 Drawing Sheets

(56) References Cited

U.S. PATENT DOCUMENTS

| | | | | |
|---|---|---|---|---|
| 9,741,281 | B2 * | 8/2017 | Kim | G09G 3/3233 |
| 10,943,555 | B2 * | 3/2021 | Yabuki | G09G 3/3677 |
| 10,978,011 | B2 * | 4/2021 | Yabuki | G09G 3/3648 |
| 2020/0265792 | A1 * | 8/2020 | Yabuki | G09G 3/3677 |

* cited by examiner

| | MUX1 | MUX2 | MUX3 | MUX4 | MUX1 | MUX2 | MUX3 | MUX4 | MUX1 | MUX2 | MUX3 | MUX4 |
|---|---|---|---|---|---|---|---|---|---|---|---|---|
| Line 1 | R | G | B | W | R | G | B | W | R | G | B | W |
| | L0 | L255 | L255 | L0 | L0 | L255 | L255 | L0 | L0 | L255 | L255 | L0 |
| Line 2 | B | W | R | G | B | W | R | G | B | W | R | G |
| | L255 | L0 | L0 | L255 | L255 | L0 | L0 | L255 | L255 | L0 | L0 | L255 |
| Line 3 | R | G | B | W | R | G | B | W | R | G | B | W |
| | L0 | L255 | L255 | L0 | L0 | L255 | L255 | L0 | L0 | L255 | L255 | L0 |
| Line 4 | B | W | R | G | B | W | R | G | B | W | R | G |
| | L255 | L0 | L0 | L255 | L255 | L0 | L0 | L255 | L255 | L0 | L0 | L255 |
Fig. 2
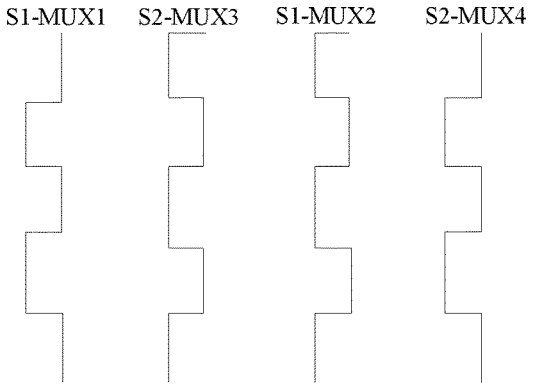
Fig. 3
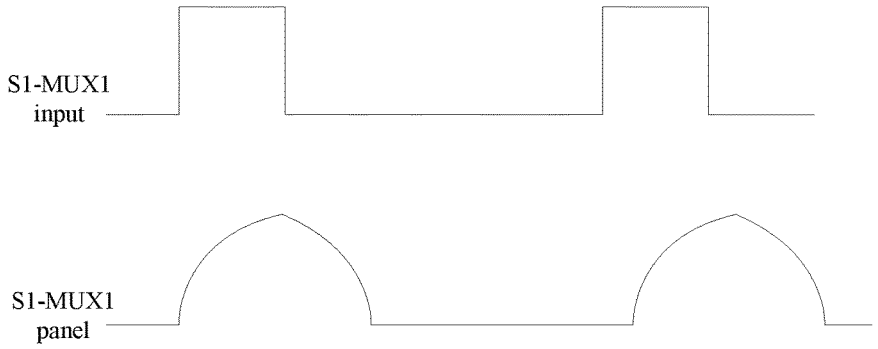
Fig. 4

METHOD FOR DRIVING DISPLAY PANEL, DISPLAY PANEL AND DISPLAY DEVICE

CROSS-REFERENCE TO RELATED APPLICATION

This application claims priority to Chinese Patent Application No. 202110068236.9, filed on Jan. 19, 2021, the entire contents of which are hereby incorporated by reference.

TECHNICAL FIELD

The present disclosure relates to the field of display technologies, and in particular, to a method for driving a display panel, a display panel and a display device.

BACKGROUND

With the rapid development of the field of display technologies, the display of smart mobile products has embarked on the upgrade path of high brightness, low power consumption, high refresh rate, and large size. Based on the requirements of high brightness and low power consumption, a Mobile RGBW product has been developed in the existing art, and the mainstream arrangement mode of the Mobile RGBW product is that sub-pixels of four colors of Red (R), Green (G), Blue (B), and White (W) are repeatedly arranged and the arrangement modes thereof in odd and even rows are different. Because the white sub-pixels are added in the arrangement mode, the effect of improving the transmittance of the display panel is significant. With the same backlight brightness, the brightness of the module with RGBW arrangement can be improved by nearly one time, and with the same brightness of the module, the energy consumption for regulating the backlight current by an algorithm is lower.

In order to improve image quality, a polarity reversal method is generally adopted to drive liquid crystal pixels in the existing art to avoid the influence of liquid crystal molecules whose orientations are kept in the same direction on liquid crystal performance. However, in the RGBW product, adjacent rows of pixels have different arrangement modes, therefore, under column inversion driving, a source drive circuit is always in toggle state when displaying a pure color image, which is equivalent to reload of a display image, and non-uniform display brightness appears at this time. Therefore, how to improve the uniformity of the brightness of the display device becomes a technical problem to be solved urgently in the field.

SUMMARY

As an aspect of the present disclosure, there is provided a method for driving a display panel having M rows of sub-pixels, applied to a driver of the display panel, the method including providing data signals to the M rows of sub-pixels, wherein providing data signals to an X-th row of sub-pixels in the M rows of sub-pixels includes: determining, for each sub-pixel in the X-th row of sub-pixels, a gray scale compensation value for a data signal provided to the sub-pixel; determining, for each sub-pixel in the X-th row of sub-pixels, an actual gray scale corresponding to the sub-pixel according to the gray scale compensation value and a theoretical gray scale value of the sub-pixel; and providing the data signals to the X-th row of sub-pixels according to the actual gray scales corresponding to the respective sub-pixels in the X-th row of sub-pixels. For each sub-pixel in the X-th row of sub-pixels, the gray scale compensation value for the data signal provided to the sub-pixel is determined by: calculating a gray scale difference value by a formula of $\delta=L_x-L_{x-1}$, where $\delta$ is the gray scale difference value, $L_x$ is the theoretical gray scale of the sub-pixel in the X-th row of sub-pixels, $L_{x-1}$ is a theoretical gray scale of a sub-pixel in an (X−1)-th row and in the same column as the sub-pixel in the X-th row of sub-pixels, X is a variable and is a natural number greater than 1 but less than or equal to M; and determining the gray scale compensation value for the data signal provided to the sub-pixel in the X-th row of sub-pixels according to the gray scale difference value and a gray scale compensation look-up table.

In some embodiments, the driver is configured to provide the data signals to the M rows of sub-pixels, a first row of sub-pixels is closest to the driver, and the step of providing the data signals to the M rows of sub-pixels satisfies the following condition: a duration for providing data signals to an M-th row of sub-pixels is longer than a duration for providing data signals to the first row of sub-pixels, and for an N-th row of sub-pixels and a K-th row of sub-pixels, a duration for providing data signals to the K-th row of sub-pixels is not less than a duration for providing data signals to the N-th row of sub-pixels, where M>K>N>1, and N and K are integers.

In some embodiments, the display panel includes a data line multiplexing circuit, a plurality of scan lines, and a plurality of data lines, the plurality of data lines are in one-to-one correspondence with a plurality of columns of sub-pixels. The driver includes a plurality of driving terminals configured to provide the data signals and each of the plurality of driving terminals corresponds to L data lines of the plurality of data lines, the data line multiplexing circuit includes L data selection signal terminals, and L is a positive integer greater than 2. The step of providing the data signals to the X-th row of sub-pixels according to the actual gray scales corresponding to the respective sub-pixels in the X-th row of sub-pixels includes: providing effective data selection signals to the L data selection signal terminals in sequence to control the data line multiplexing circuit to cause each driving terminal of the plurality driving terminals to be electrically coupled with the L data lines corresponding to the driving terminal in sequence. A duration of an effective level of a data selection signal when providing the data signal to the M-th row of subpixels is longer than a duration of an effective level of a data selection signal when providing the data signal to the first row of sub-pixels, and a duration of an effective level of a data selection signal when providing the data signal to the K-th row of sub-pixels is not less than a duration of an effective level of a data selection signal when providing the data signal to the N-th row of sub-pixels.

In some embodiments, the data line multiplexing circuit includes a plurality of multiplexing modules and L data selection signal lines, each of the plurality of multiplexing modules has one input terminal, L multiplexing control terminals, and L output terminals, the input terminal is coupled to a corresponding driving terminal of the driver, the L output terminals are respectively coupled to L data lines corresponding to the corresponding driving terminal, the L multiplexing control terminals of the multiplexing module are respectively coupled to the L data selection signal terminals of the data line multiplexing circuit through the L data selection signal lines, the multiplexing module is capable of electrically coupling the input terminal with a corresponding output terminal upon receipt of an effective data selection signal at each of the plurality of multiplexing control terminals. The step of providing the data signals to the X-th row of sub-pixels according to the actual gray scales corresponding to the respective sub-pixels in the X-th row of sub-pixels includes: providing the effective data selection signals to the L data selection signal terminals in sequence to control each of the plurality of multiplexing modules to cause a corresponding driving terminal to be electrically coupled with the L data lines corresponding to the corresponding driving terminal in sequence.

In some embodiment, each of the plurality of multiplexing modules includes L switch transistors, first electrodes of the L switch transistors are all coupled to the input terminal, control electrodes of the L switch transistors are respectively coupled to the L data selection signal lines, and second electrodes of the L switch transistors are respectively coupled to the L data lines in a one-to-one correspondence manner.

In some embodiment, the step of providing the data signals to the M rows of sub-pixels further satisfies the following condition: a duration for providing data signals to each row of sub-pixels is the same from the first row of sub-pixels to an (O−1)-th row of sub-pixels, a duration for providing data signals to each row of sub-pixels is the same from a Y-th row of sub-pixels to the M-th row of sub-pixels, and a duration for providing data signals to each row of sub-pixels is gradually increased from the O-th row of sub-pixels to the Y-th row of sub-pixels, where $1<O<Y<M$, and O and Y are integers.

In some embodiment, the step of providing the data signals to the M rows of sub-pixels further satisfies the following condition: a duration for providing data signals to each row of sub-pixels is gradually increased from the first row of sub-pixels to the M-th row of sub-pixels.

In some embodiment, the driver includes a data buffer for storing data signals, and the duration for providing the data signals to the M-th row of sub-pixels is determined by: determining a difference of T2−T1 between the duration for providing the data signals to the M-th row of sub-pixels and the duration for providing the data signals to the first row of sub-pixels according to a calculation formula of $T2-T1=L1\times H/H1$, where T2 is the duration for providing the data signals to the M-th row of sub-pixels, T1 is the duration for providing the data signals to the first row of sub-pixels, H is an average of durations for providing data signals to respective rows of sub-pixels by the driver, H1 is a number of rows of sub-pixels to be compensated, L1 is a total number of rows of sub-pixels buffered by the data buffer, $H=1/(f\times M)$, and f is a refresh rate of the display panel; and determining the duration for providing the data signals to the M-th row of sub-pixels according to the difference of T2−T1.

In some embodiments, providing data signals to the first row of sub-pixels includes: providing the data signals to the first row of sub-pixels according to theoretical gray scale values corresponding to respective sub-pixels in the first row of sub-pixels.

As a second aspect of the present disclosure, there is provided a display panel including a driver configured to provide data signals to M rows of sub-pixels, and a first row of sub-pixels is closest to the driver, and the driver is configured to implement the above-described method.

In some embodiments, the driver includes a look-up table module configured to: determine, for each sub-pixel in the X-row of sub-pixels, the gray scale compensation value for the data signal provided to the sub-pixel in the X-row of sub-pixels, determine, for each sub-pixel in the X-row of sub-pixels, the actual gray scale corresponding to the sub-pixel according to the gray scale compensation value and the theoretical gray scale value of the sub-pixel, and provide the data signals to the X-th row of sub-pixels according to the actual gray scales corresponding to the respective sub-pixels in the X-row of sub-pixels. For each sub-pixel in the X-th row of sub-pixels, the gray scale compensation value for the data signal provided to the sub-pixel is determined by: calculating the gray scale difference value by the formula of $\delta=L_x-L_{x-1}$, where δ is the gray scale difference value, $L_x$ is the theoretical gray scale of the sub-pixel in the X-th row of sub-pixels, $L_{x-1}$ is the theoretical gray scale of a sub-pixel in the (X−1)-th row and in the same column as the sub-pixel in the X-th row of sub-pixels, X is a variable and is a natural number greater than 1 but less than or equal to M; and determining the gray scale compensation value for the data signal provided to the sub-pixel in the X-th row of sub-pixels according to the gray scale difference value and the gray scale compensation look-up table.

In some embodiments, the driver is configured such that a duration for providing data signals to an M-th row of sub-pixels is longer than a duration for providing data signals to the first row of sub-pixels, and for an N-th row of sub-pixels and a K-th row of sub-pixels, a duration for providing data signals to the K-th row of sub-pixels is not less than a duration for providing data signals to the N-th row of sub-pixels, where $M>K>N>1$, and N and K are integers.

In some embodiments, the display panel includes a data line multiplexing circuit, a plurality of scan lines, and a plurality of data lines, the plurality of data lines are in one-to-one correspondence with a plurality of columns of sub-pixels. The driver includes a plurality of driving terminals configured to provide the data signals and each of the plurality of driving terminals corresponds to L data lines of the plurality of data lines, the data line multiplexing circuit includes L data selection signal terminals, and L is a positive integer greater than 2.

In some embodiments, the data line multiplexing circuit includes a plurality of multiplexing modules and L data selection signal lines, each of the plurality of multiplexing modules has one input terminal, L multiplexing control terminals, and L output terminals, the input terminal is coupled to a corresponding driving terminal of the driver, the L output terminals are respectively coupled to L data lines corresponding to the corresponding driving terminal, the L multiplexing control terminals of the multiplexing module are respectively coupled to the L data selection signal terminals of the data line multiplexing circuit through the L data selection signal lines, the multiplexing module is capable of electrically coupling the input terminal with a corresponding output terminal upon receipt of an effective data selection signal at each of the plurality of multiplexing control terminals.

In some embodiments, each of the plurality of multiplexing modules includes L switch transistors, first electrodes of the L switch transistors are all coupled to the input terminal, control electrodes of the L switch transistors are respectively coupled to the L data selection signal lines, and second electrodes of the L switch transistors are respectively coupled to the L data lines in a one-to-one correspondence manner.

In some embodiments, the driver is configured such that a duration for providing data signals to each row of sub-pixels is the same from the first row of sub-pixels to an (O−1)-th row of sub-pixels, a duration for providing data signals to each row of sub-pixels is the same from a Y-th row of sub-pixels to the M-th row of sub-pixels, and a duration for providing data signals to each row of sub-pixels is gradually increased from the O-th row of sub-pixels to the Y-th row of sub-pixels, where $1<O<Y<M$, and O and Y are integers.

In some embodiment, the driver is configured such that a duration for providing data signals to each row of sub-pixels is gradually increased from the first row of sub-pixels to the M-th row of sub-pixels.

In some embodiments, the driver includes a data buffer for storing data signals, and the driver is further configured to: determine a difference of T2−T1 between the duration for providing the data signals to the M-th row of sub-pixels and the duration for providing the data signals to the first row of sub-pixels according to a calculation formula of $T2-T1=L1\times H/H1$, and determine the duration for providing the data signals to the M-th row of sub-pixels according to the difference of T2−T1, where T2 is the duration for providing the data signals to the M-th row of sub-pixels, T1 is the duration for providing the data signals to the first row of sub-pixels, H is an average of durations for providing data signals to the respective rows of sub-pixels by the driver, H1 is a number of rows of sub-pixels to be compensated, L1 is a total number of rows of sub-pixels buffered by the data buffer, $H=1/(f\times M)$, and f is a refresh rate of the display panel.

As a third aspect of the present disclosure, there is provided a display device, including the above-described display panel.

BRIEF DESCRIPTION OF THE DRAWINGS

The accompanying drawings, which are used to provide further understanding of the present disclosure and constitute a part of this specification, serve to explain the present disclosure together with the following specific implementations, but do not constitute a limitation of the present disclosure. In the drawings:

FIG. 2 is a schematic diagram illustrating gray scales of sub-pixels when an image is displayed on the display panel according to an embodiment of the present disclosure;

FIG. 3 is a timing diagram of data signals corresponding to the first four data lines when the image shown in FIG. 2 is displayed on the display panel according to an embodiment of the present disclosure;

FIG. 4 is a schematic diagram illustrating an effect of a driver charging one sub-pixel in a display panel according to an embodiment of the present disclosure;

DETAILED DESCRIPTION

The specific embodiments of the present disclosure will be described below in detail with reference to the accompanying drawings. It should be understood that the specific embodiments described here are only used to illustrate and explain the present disclosure, and are not used to limit the present disclosure.

It has been found in research by the inventor of the present application that, the main reason for the problem of the brightness uniformity of the displayed screen on the existing large-size display panel is that the resistance-capacitance (RC) of the driving circuit in the large-size display panel is accumulated in the direction away from the driver (IC), resulting in a large difference between the data signal actually received by a far-end sub-pixel (that is, a sub-pixel far away from the driver) and the data signal sent by the driver, which in turn results in a difference between the brightness of a near-end sub-pixel (that is, a sub-pixel closer to the driver) and the brightness of the far-end sub-pixel, thereby affecting brightness uniformity of the displayed screen on the display panel. In addition, for display panels (for example, display panels suitable for mobile electronic products) with a refresh rate of 120 Hz or higher, the charging time of the pixels during the display process is extremely short. As the screen size increases, the RC of the circuit on the display panel increases, which will also lead to insufficient charging time of the pixels and reduce the brightness uniformity of the displayed screen on the display panel.

Figure 10:
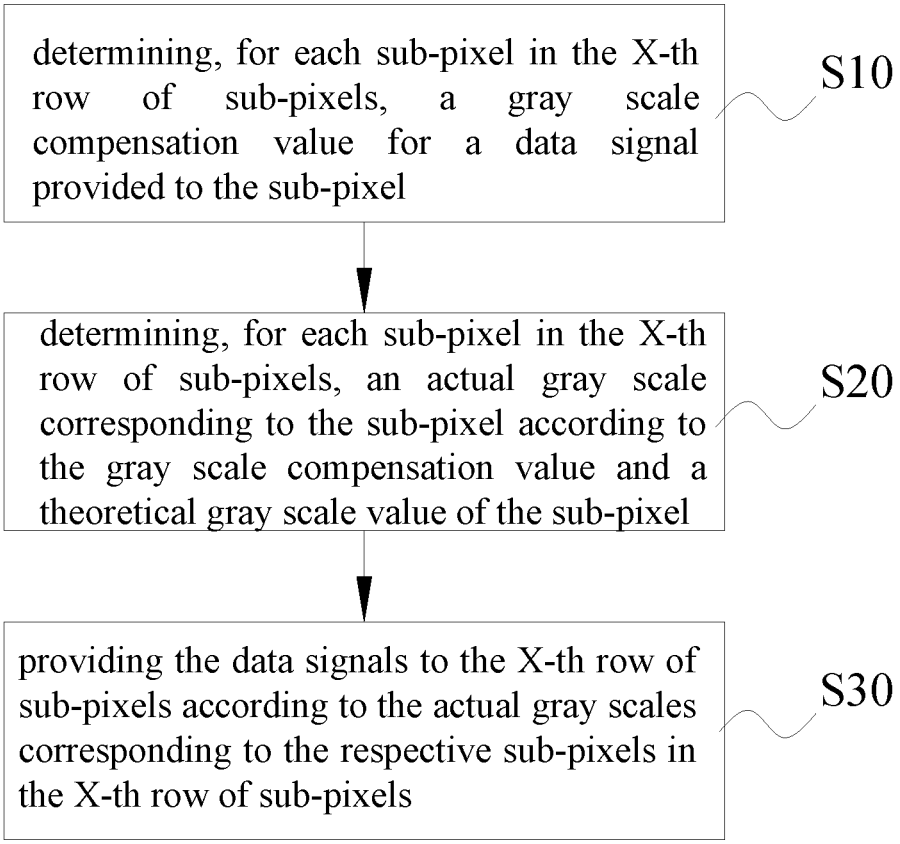
FIG. 10 is a flowchart of a driving method according to an embodiment of the present disclosure.

In order to solve the above technical problems, as an aspect of the present disclosure, there is provided a method for driving a display panel, which is applied to a driver (IC) of the display panel, the display panel includes M rows of sub-pixels, and as shown in FIG. 10, the method includes: providing data signals to the M rows of sub-pixels, wherein providing data signals to an X-th row of sub-pixels in the M rows of sub-pixels (X and M are integers, and $1<X\leq M$) includes steps S10 to S30.

In step S10, for each sub-pixel in the X-th row, a gray scale compensation value for a data signal provided to the sub-pixel is determined.

In step S20, for each sub-pixel in the X-th row, an actual gray scale corresponding to the sub-pixel is determined according to the gray scale compensation value and a theoretical gray scale value of the sub-pixel.

In step S30, the data signals are provided to the X-th row of sub-pixels according to the actual gray scales corresponding to the respective sub-pixels in the X-th row of sub-pixels. For example, in FIG. 9, the shaded portion of the data enable signal SD (only the blue (B) and green (G) sub-pixels are involved in this embodiment, but sub-pixels of other color(s) may be involved in other embodiments) represents the voltage value v2−v1 finally compensated for the data signal.

For each sub-pixel in the X-th row, the gray scale compensation value for the data signal provided to the sub-pixel is determined by the following steps S11 and S12.

In step S11, a gray scale difference value is calculated by the formula $\delta=L_x-L_{x-1}$, where δ is the gray scale difference value, $L_x$ is the theoretical gray scale of the sub-pixel in the X-th row of sub-pixels, $L_{x-1}$ is a theoretical gray scale of a sub-pixel in an (X−1)-th row of sub-pixels and in the same column as the sub-pixel in the X-th row of sub-pixels, and X is a variable.

In step S12, the gray scale compensation value for the data signal provided to the sub-pixel in the X-th row of sub-pixels is determined according to the gray scale difference value and a gray scale compensation look-up table.

In the embodiment of the present disclosure, when the driver provides data signals to at least one row of sub-pixels (which may be, for example, at least one row of second to the M-th rows), a gray scale difference value (i.e., the gray scale difference value δ) is obtained by comparing a gray scale corresponding to the data signal provided to each sub-pixel in the at least one row and a gray scale corresponding to a data signal provided to a corresponding sub-pixel (e.g., a sub-pixel in the same column as the sub-pixel in the at least one row) in a previous row of sub-pixels receiving the data signals, and then a gray scale compensation value is determined by looking up a gray scale compensation look-up table according to the gray scale difference value, so as to perform gray scale compensation on the data signals provided to the current row of sub-pixels, thereby improving brightness uniformity of an image displayed by the display panel, eliminating brightness reduction phenomenon of the far-end sub-pixel caused by an influence of circuit RC on amplitude of the data signal received by the far-end sub-pixel, and improving an image display effect of the display panel.

It is understood that, for the first row of sub-pixels, since the influence of the circuit RC is small, the gray scale compensation may be not performed, in other words, the gray scale compensation value for every sub-pixel in the first row of sub-pixels may be set to 0. That is, the theoretical gray scales of the first row of sub-pixels may be used as the actual gray scales of the first row of sub-pixels. The method for driving the display panel according to the embodiment of the present disclosure includes: providing data signals to respective rows of sub-pixels (from the first to the M-th rows of sub-pixels) of the display panel, wherein providing data signals to each row of sub-pixels from the second to M-th rows of sub-pixels may include the above steps S10, S20 and S30, and the gray scale compensation value is determined through the steps S11 and S12; and providing the data signals to the first row of sub-pixels include providing theoretical gray scale values to the first row of sub-pixels.

Figure 7:
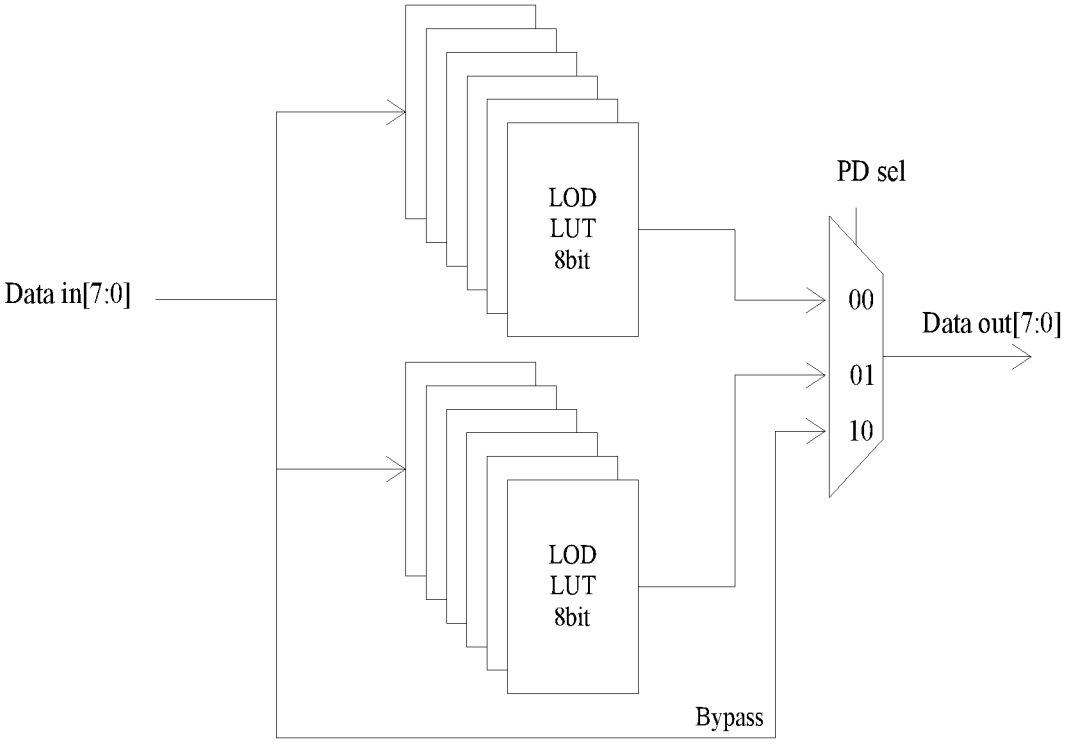
FIG. 7 is a schematic diagram illustrating a LUT module in a display panel comparing data signals corresponding to adjacent two rows of sub-pixels according to an embodiment of the present disclosure.
Figure 13:
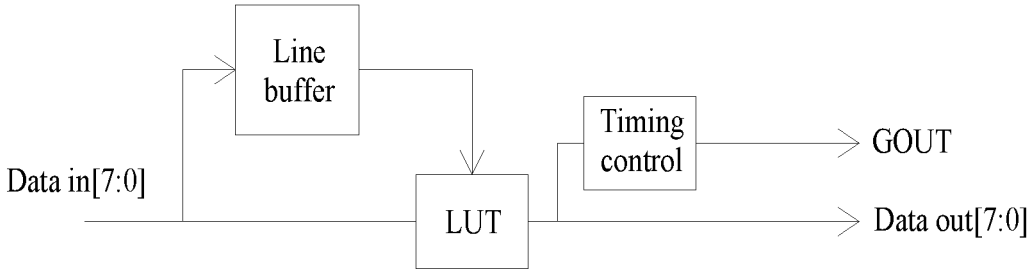
FIG. 13 is a schematic diagram illustrating a structure of a driver in a display panel according to an embodiment of the present disclosure.

As shown in FIG. 7 and FIG. 13, the gray scale comparing step (steps S11 and S12) may be implemented by a look-up table (LUT) module in the driver, a data buffer (line buffer) in the driver inputs data signals (for example, the data signal is an 8-bit signal, and is represented by [7:0]) into the look-up table module row by row, the look-up table module compares the gray scale of each sub-pixel in the current row (X-th row) of sub-pixels and the gray scale of a corresponding sub-pixel in a previous row ((X−1)-th row) of sub-pixels (i.e., compares the gray scales $L_x$ and $L_{x-1}$ of adjacent two sub-pixels in the same column) to obtain a gray scale difference value δ, and determines a compensation gray scale value corresponding to each sub-pixel in the current row (X-th row) by looking up a gray scale compensation look-up table stored in the look-up table module, where voltage values required to be compensated are different for different gray scales. The look-up table module outputs data signals to the panel and generates matching timing signals (time sequence signals) and Gout signals (scanning signals), the interval and the width of each signal can be independently set and adjusted by the driver. Of course, the driver also includes other known units, such as driver OP (not shown) for analog conversion, which are not repeatedly described herein.

It should be noted that the gray scale compensation look-up table may be obtained by performing a plurality of tests on the display panel in advance, the gray scale compensation values to be provided to each sub-pixel in each row of sub-pixels in response to different gray scale difference values between the sub-pixel and the corresponding sub-pixel (the sub-pixel in the same column as the sub-pixel) in the previous row of sub-pixels are stored in the gray scale compensation look-up table, and in step S10, the look-up table module may directly find the corresponding gray scale compensation value in the pre-stored gray scale compensation look-up table according to the gray scale difference value S.

Figure 11:
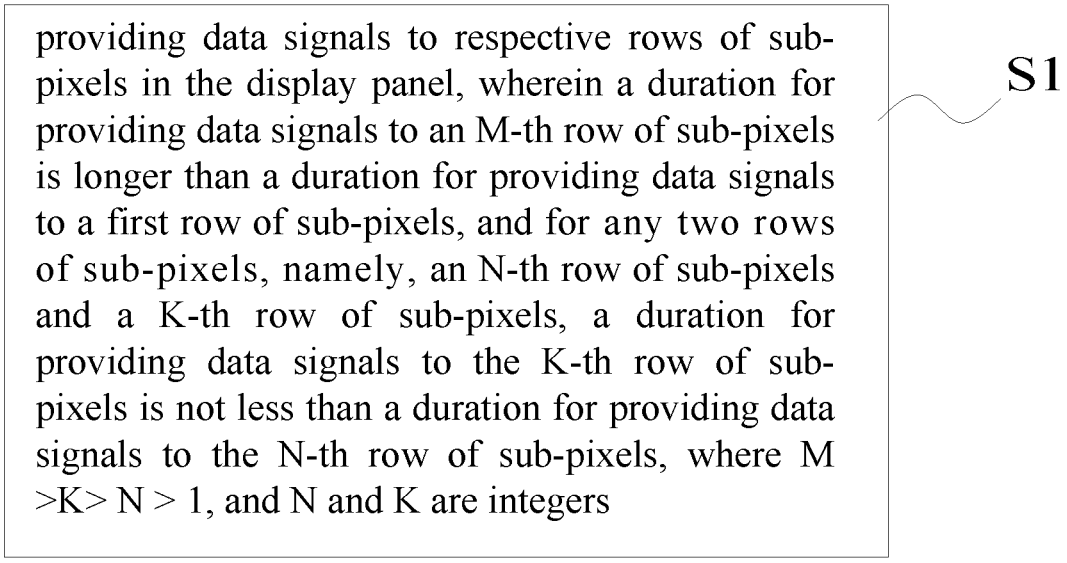
FIG. 11 is a flowchart of a driving method according to another embodiment of the present disclosure.

In order to improve the brightness uniformity of the image displayed by the display panel, in some embodiments, the driver is configured to provide the data signals to the M rows of sub-pixels, and the first row of sub-pixels is closest to the driver (i.e., the distance between a row of sub-pixels and the IC increases from the first row of sub-pixels to the M-th row of sub-pixels). As shown in FIG. 11, the driving method of the present disclosure includes step S1.

In step S1, data signals are provided to the M rows of sub-pixels in the display panel, wherein a duration for providing data signals to the M-th row of sub-pixels is longer than a duration for providing data signals to the first row of sub-pixels, and for any two rows of sub-pixels, namely, an N-th row of sub-pixels and a K-th row of sub-pixels, a duration for providing data signals to the K-th row of sub-pixels is not less than a duration for providing data signals to the N-th row of sub-pixels, where M>K>N>1, and K and N are both integers.

In the embodiment of the present disclosure, the duration for the driver to provide data signals to at least one row of sub-pixels away from the driver (referred to as a row of far-end sub-pixels thereinafter) is longer than the duration for the driver to provide data signals to a row of sub-pixels close to the driver (referred to as a row of near-end sub-pixels thereinafter), thereby prolonging the charging time of the far-end sub-pixels, ensuring that the charging rates of the far-end sub-pixels and the near-end sub-pixels are consistent, avoiding the reduction of the brightness of the far-end sub-pixels caused by the influence of circuit RC on the amplitudes of the data signals received by the far-end sub-pixels, and improving the brightness uniformity of the image displayed by the display panel. It is understood that the driving method described above with reference to FIG. 10 may be combined with the driving method described above with reference to FIG. 11, and in this case, when the driving method described with reference to FIG. 10 is used for driving respective rows of sub-pixels, it is also necessary to simultaneously satisfy that a duration for providing data signals to the M-th row of sub-pixels is longer than a duration for providing data signals to the first row of sub-pixels, and for any two rows of sub-pixels (i.e., a K-th row of sub-pixels and an N-th row of sub-pixels), a duration for providing data signals to the K-th row of sub-pixels is not less than a duration for providing data signals to the N-th row of sub-pixels, where M>K>N>1, and K and N are both integers. In this way, the brightness uniformity of the image displayed by the display panel can be further improved.

The structure of the pixel driving circuit of the display panel is not particularly limited in the embodiments of the present disclosure. For example, in some embodiments, the pixel driving circuit of the display panel may adopt a multiplexing scheme.

Figure 1:
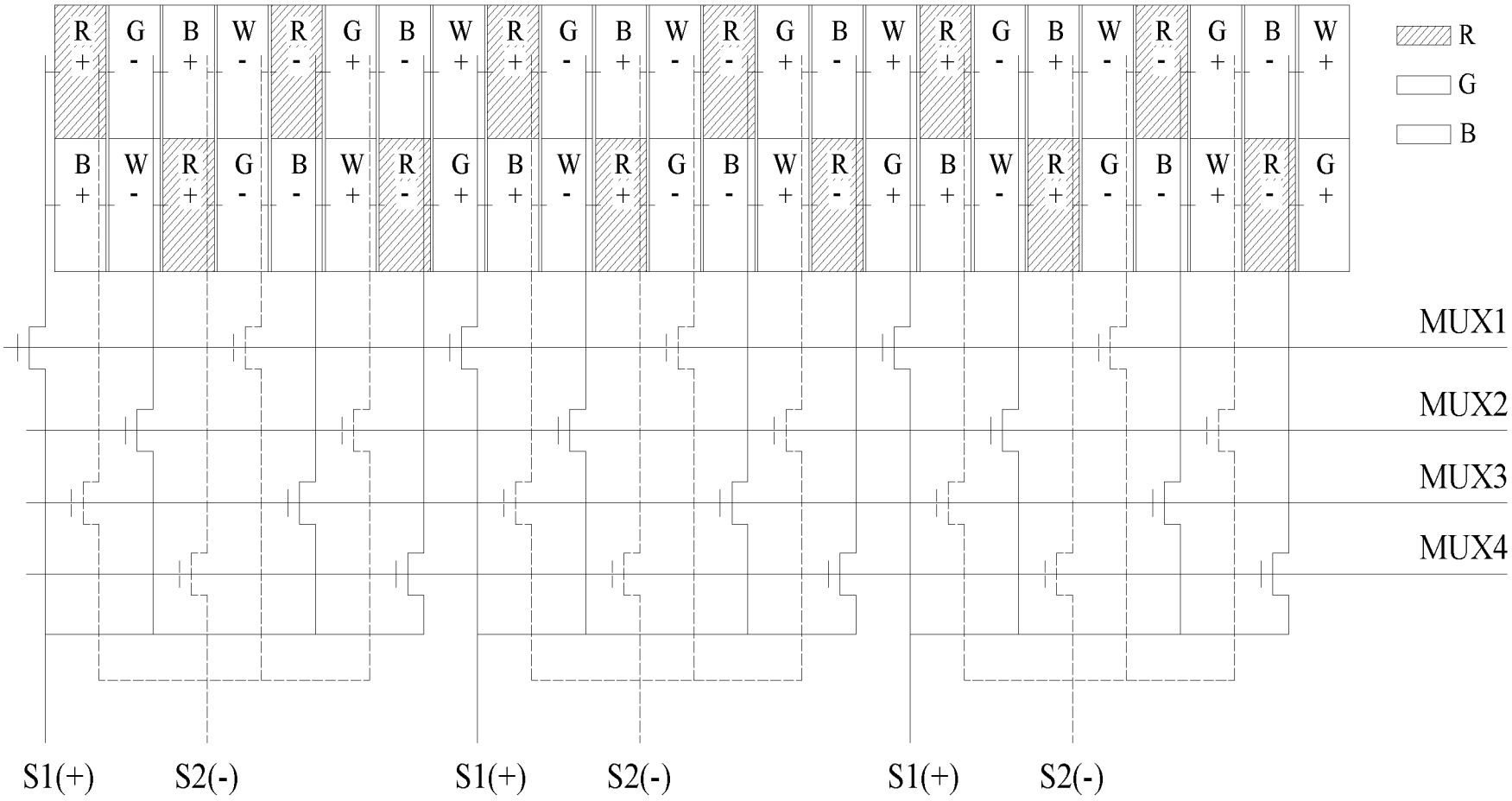
FIG. 1 is a schematic circuit diagram of a display panel according to an embodiment of the present disclosure.

As shown in FIG. 1, the display panel may include a data line multiplexing circuit, a plurality of scan lines, and a plurality of data lines. The plurality of data lines are in one-to-one correspondence with a plurality of columns of sub-pixels. The driver includes a plurality of driving terminals (e.g., ports denoted as S1 and S2 in a lower portion of FIG. 1) for providing data signals, and each of the driving terminals corresponds to L data lines. The data line multiplexing circuit includes L data selection signal terminals (MUX1, MUX2, MUX3, MUX4 . . . ), and L is a positive integer greater than 2. The step of providing the data signals to the X-th row of sub-pixels according to the actual gray scales corresponding to the respective sub-pixels in the X-th row of sub-pixels includes: providing effective data selection signals to the L data selection signal terminals in sequence to control the data line multiplexing circuit to cause each driving terminal to be electrically coupled with the L data lines corresponding to the driving terminal in sequence; where a duration of an effective level of a data selection signal when providing the data signals to the M-th row of sub-pixels is longer than a duration of an effective level of a data selection signal when providing the data signals to the first row of sub-pixels b, and a duration of an effective level of a data selection signal when providing the data signals to the K-th row of sub-pixels is longer than a duration of an effective level of a data selection signal when providing the data signals to the N-th row of sub-pixels.

The number L of the data selection signal terminals in the data line multiplexing circuit is not particularly limited, and may be equal to the number of colors of the sub-pixels included in a display unit. For example, in the case where the display unit includes RGBW sub-pixels as shown in FIG. 1, L may be 4, that is, the data line multiplexing circuit may have four data selection signal terminals MUX1, MUX2, MUX3, and MUX4, and each driving terminal corresponds to four data lines. In this case, the sub-pixels of the same color in each row of sub-pixels are coupled to one of the data selection signal terminals MUX1, MUX2, MUX3 and MUX4, and four data lines corresponding to each driving terminal (e.g., S1, S2) are coupled to the sub-pixels of four different colors. Exemplarily, as shown in FIG. 1, the red sub-pixels (R) in the first row are coupled to the data selection signal terminal MUX1; the blue sub-pixels (B) in the first row are coupled to the data selection signal terminal MUX2; the green sub-pixels (G) in the first row are coupled to the data selection signal terminal MUX3; and the white sub-pixels (W) in the first row are coupled to the data selection signal terminal MUX4. The data line multiplexing circuit respectively couples each driving terminal (e.g., S1 port, S2 port) of the driver (IC) to the data lines of the corresponding four columns of sub-pixels in turn under the control of the data selection signals received by the four data selection signal terminals MUX1, MUX2, MUX3, and MUX4 in the process of displaying each frame.

The circuit structure of the data line multiplexing circuit is not particularly limited in the embodiments of the present disclosure. For example, in some embodiments, as shown in FIG. 1, the data line multiplexing circuit includes a plurality of multiplexing modules and L data selection signal lines (e.g., MUX1, MUX2, MUX3, MUX4), each multiplexing module has one input terminal, L (e.g., 4) multiplexing control terminals, and L (e.g., 4) output terminals. The input terminal is coupled to a corresponding driving terminal of the driver, the L (e.g., 4) output terminals are respectively coupled to L (e.g., 4) data lines corresponding to the driving terminal, the L (e.g., 4) multiplexing control terminals of the multiplexing module are respectively coupled to L (e.g., 4) data selection signal terminals of the data line multiplexing circuit through L (e.g., 4) data selection signal lines, the multiplexing module is capable of electrically coupling the input terminal with a corresponding output terminal upon receipt of an effective data selection signal at each multiplexing control terminal.

Further, as shown in FIG. 1, the multiplexing module may include L (4) switch transistors, first electrodes of the L switch transistors are all coupled to the input terminal, control electrodes of the L (4) switch transistors are respectively coupled to the L (4) data selection signal lines, and second electrodes of the L switch transistors are respectively coupled to the L (4) data lines in a one-to-one correspondence manner.

Figure 5:
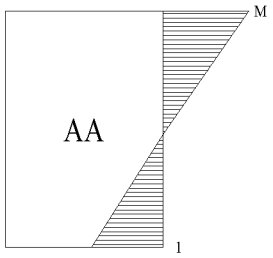
FIG. 5 is a schematic diagram illustrating time relationship of durations for providing by a driver data signals to respective rows of sub-pixels in a display panel according to an embodiment of the present disclosure.
Figure 8:
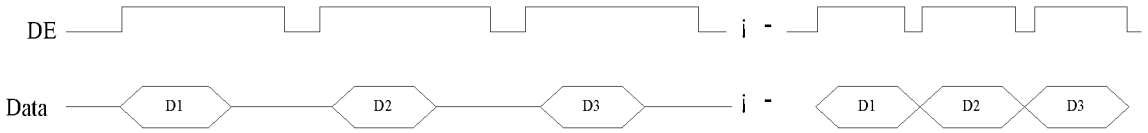
FIG. 8 is a timing diagram illustrating time relationship of durations for providing by a driver data signals to respective rows of sub-pixels in a display panel according to an embodiment of the present disclosure.
Figure 9:
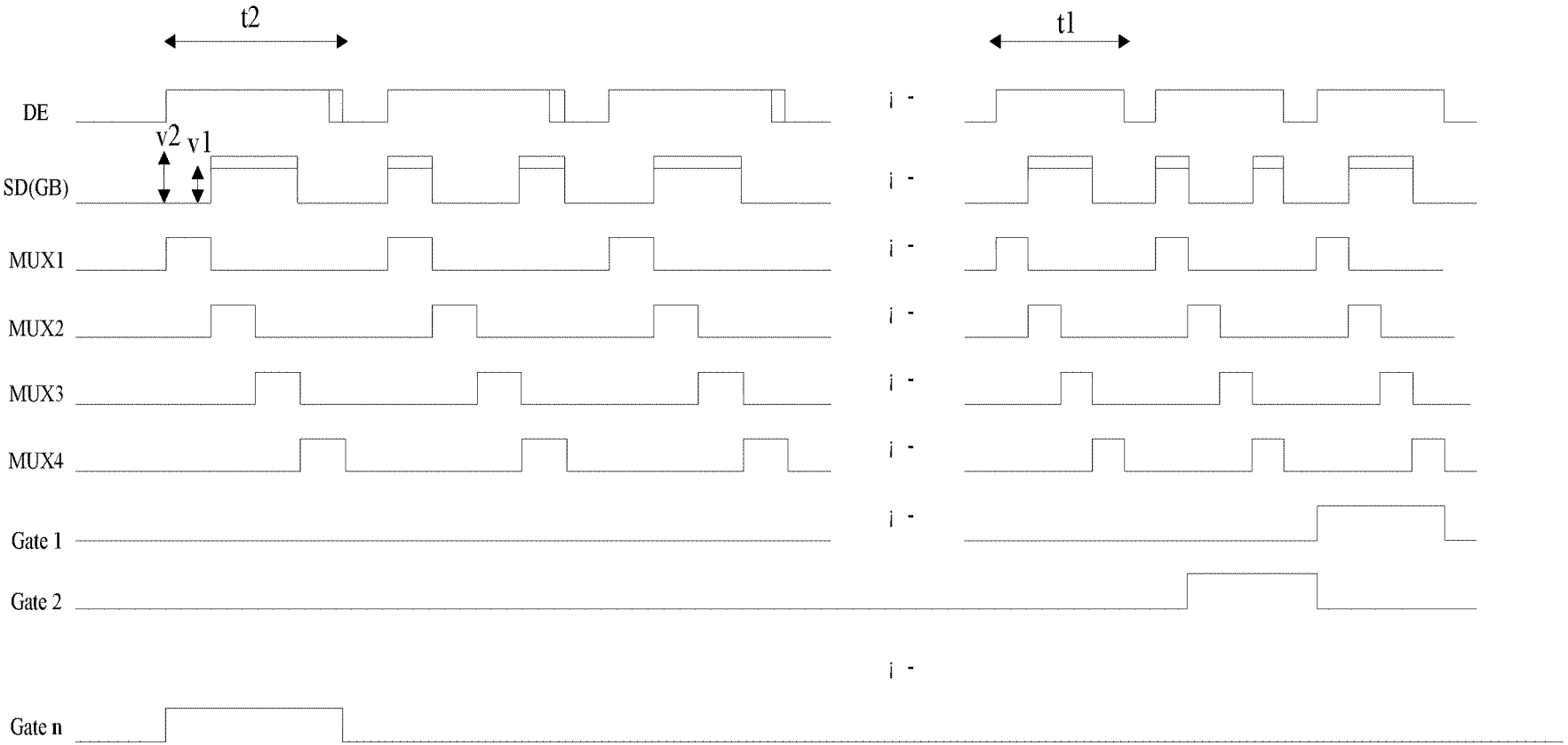
FIG. 9 is a timing diagram of signals sent by a driver in a display panel to a data line multiplexing circuit and a pixel circuit according to an embodiment of the present disclosure.

To facilitate understanding of those skilled in the art, FIG. 3 is a timing diagram of data signals corresponding to the first four data lines when the image shown in FIG. 2 is displayed on the display panel provided by the embodiment of the present disclosure. FIG. 4 is a schematic diagram showing the effect of charging the first column of sub-pixels by data signals provided by the port S1 when the port S1 is electrically coupled to the first column of sub-pixels coupled to the MUX1, FIG. 8 is a timing diagram schematically illustrating durations for providing by a driver data signals to respective rows of sub-pixels, and FIG. 9 is a timing diagram of signals sent by a driver to the data line multiplexing circuit and the pixel circuit in a case where the data line multiplexing circuit has four data selection signal lines. The driver controls, through the scan lines Gate 1 to Gate n, a plurality of rows of sub-pixels to be scanned from the n-th row of sub-pixels farthest from the driver (when the driver provides data signals to M rows of sub-pixels, n=M) to the first row of sub-pixels nearest to the driver. As shown in FIG. 5, when the n-th, (n−1)-th, (n−2)-th . . . rows of sub-pixels are sequentially scanned, the duration of the effective data enable (DE) signal (i.e., the sum of durations in which the data signals are provided to the four columns of sub-pixels, as indicated by t2 in FIG. 9), which is substantially equal to the scan time, is prolonged (the shade portion in FIG. 9 is the prolonged portion) so as to ensure that the driver can charge a row of far-end sub-pixels and a row of near-end sub-pixels at the same charging rate.

The embodiment of the present disclosure does not specifically limit the portion (row) involved in the adjustment of the duration of the data signals, for example, as shown in FIG. 5, providing the data signals to the M rows of sub-pixels further satisfies the following condition: the duration for providing data signals to each row of sub-pixels is gradually increased from the first row of sub-pixels to the M-th row of sub-pixels, and the charging time of each row of sub-pixels is gradually increased from near to far in a gradual change mode.

Figure 6:
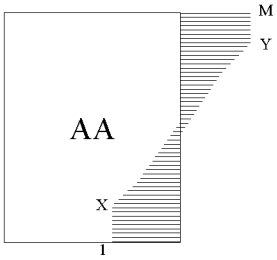
FIG. 6 is a schematic diagram illustrating time relationship of durations for providing by a driver data signals to respective rows of sub-pixels in a display panel according to another embodiment of the present disclosure.

In order to avoid the excessive adjustment of the charging time of the near-end sub-pixels and the far-end sub-pixels, in an embodiment and as shown in FIG. 6, the step of providing the data signals to the M rows of sub-pixels further satisfies the following condition: the duration for providing data signals to each row of sub-pixels is the same from the first row of sub-pixels to the O-th row of sub-pixels, the duration for providing data signals to each row of sub-pixels is the same from the Y-th row of sub-pixels to the M-th row of sub-pixels, the duration for providing data signals to each row of sub-pixels is gradually increased from the O-th row of sub-pixels to the Y-th row of sub-pixels, where 1<O<Y<M, and O and Y are integers. That is, in this embodiment of the present disclosure, the charging time is gradually compensated for only in the middle area of the display panel, and the charging time of each of multiple rows of sub-pixels is the same in the area close to the edge of the display panel, so as to avoid the edge of the display panel from being too bright or too dark, and improve the display effect.

It should be noted that, the duration in which the driver provides the data signals to each row of sub-pixels has the following principle: the duration for providing data signals to a row of near-end pixels is shortened, and the duration for providing data signals to a row of far-end sub-pixels is prolonged, and the sum of the prolonged time is equal to the sum of the shortened time. For example, as shown in FIGS. 5 and 6, the AA area indicates the display area of the display panel, and the width in the horizontal direction of the shaded portion on the right side indicates the magnitude of the difference between the charging time of each row of sub-pixels and the average charging time of the plurality rows of sub-pixels, it can be seen that the sum of the prolonged time is equal to the sum of the shortened time.

Figure 12:
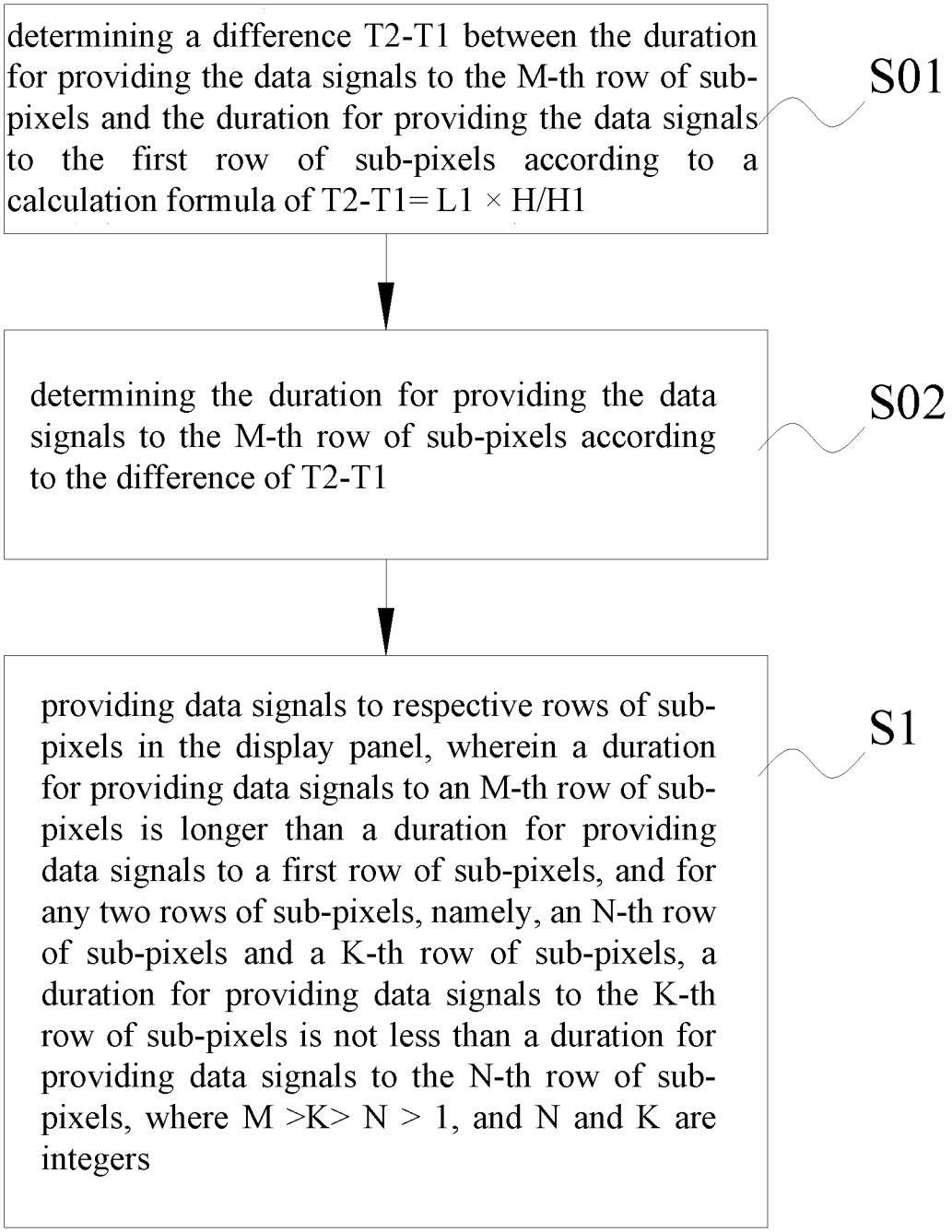
FIG. 12 is a flowchart of a driving method according to another embodiment of the present disclosure.

In some embodiments, the driver includes a data buffer (line buffer) for storing the data signal, and the driver is configured to, after receiving the information to be displayed, pre-store the information to be displayed in the buffer memory of the data buffer, and output the data signals after delaying the data signals by a time of about (T2−T1) from the buffer memory of the data buffer when transmitting the data signals to a row of far-end sub-pixels (e.g., the M-th row of sub-pixels). In some embodiments, as shown in FIG. 12, the driving method further includes steps S01 and S02.

In step S01, a difference, i.e., T2−T1 (also referred to as compensation value), between the duration for providing the data signals to the M-th row of sub-pixels and the duration for providing the data signals to the first row of sub-pixels is determined according to a calculation formula of T2−T1=L1×H/H1, where T2 is the duration for providing the data signals to the M-th row of sub-pixels (which may correspond to t2 in FIG. 9), T1 is the duration for providing the data signals to the first row of sub-pixels (which may correspond to t1 in FIG. 9), H is an average of the durations for providing the data signals to respective rows of sub-pixels by the driver, H1 is the number of rows of sub-pixels to be compensated, L1 is the total number of rows of sub-pixels buffered by the data buffer, H=1/(f×M), and f is a refresh rate of the display panel.

In step S02, the duration for providing the data signals to the M-th row of sub-pixels is determined according to the difference of T2−T1.

In order to implement the above scheme of delaying the duration by T2−T1, in some embodiments, the interface transmission rate of the driver needs to be increased by F1 compared with the interface transmission rate of the existing driver, and F1=1/(H−T2+T1).

It should be noted that the compensation value (T2−T1) obtained according to the above formula T2−T1=L1×H/H1 is the maximum value of compensation values for all rows of far-end sub-pixels. In practical applications, the compensation values of the sub-pixels in different rows may be equal or unequal (in other words, the compensation value for each row of sub-pixels may be calculated by monomial or polynomial as required), but cannot be greater than the maximum value.

The colors of the sub-pixels included in the display panel are not particularly limited, and the display panel may include sub-pixels of a plurality of colors. For example, the display panel may include sub-pixels of four colors RGBW, odd rows of sub-pixels have the same color arrangement, even rows of sub-pixels have the same color arrangement, an odd row of sub-pixels and an even row of sub-pixels have different color arrangements, and sub-pixels of the four colors in each row of sub-pixels are alternately arranged. For example, for any adjacent two rows of sub-pixels, the color arrangement for one row of sub-pixels is an RGBW repeated arrangement, and a color arrangement for the other row of sub-pixels is a BWRG repeated arrangement, as shown in FIG. 1 and FIG. 2.

In the case where different data selection signal lines (e.g., MUX1 to MUX4) are used for controlling charging of the sub-pixels having different colors, when displaying a specific display screen, defects such as defective vertical displayed lines may occur due to mux coupling effect. In order to avoid the problem, in an embodiment, the driver is configured to provide data signals with different polarities to the sub-pixels. That is, the potentials on the pixel electrode of the sub-pixel are positive potentials higher than the common electrode voltage (Vcom) and negative potentials lower than the common electrode voltage (Vcom), respectively, such that the signs of the voltage differences between the pixel electrodes of different sub-pixels and the common electrode are opposite.

The distribution pattern of the polarities of the sub-pixels on the display panel is not particularly limited in the embodiments of the present disclosure, for example, the distribution pattern of the polarities of the sub-pixels may be in a column inversion mode, as shown in FIG. 1, in adjacent two columns of sub-pixels, the polarities of the data signals of two sub-pixels located in the same row are different.

As a second aspect of the present disclosure, a display panel is provided, the display panel includes a driver for providing data signals to M rows of sub-pixels, and a first row of sub-pixels is closest to the driver, the driver is capable of implementing the above driving method provided by the embodiments of the present disclosure. In some embodiments, when providing data signals to an X-th row of sub-pixels in the M rows of sub-pixels (X is a natural number greater than 1 and equal to or less than M), the driver is configured to: determine, for each sub-pixel in the X-th row of sub-pixels, a gray scale compensation value for a data signal provided to the sub-pixel; determine, for each sub-pixel in the X-th row of sub-pixels, an actual gray scale corresponding to the sub pixel according to the gray scale compensation value and a theoretical gray scale value of the sub-pixel; and provide the data signals to the X-th row of sub-pixels according to the actual gray scales corresponding to the respective sub-pixels in the X-th row of sub-pixels. For each sub-pixel in the X-th row of sub-pixels, the gray scale compensation value for the data signal provided to the sub-pixel is determined by: calculating a gray scale difference value by a formula $\delta=L_x-L_{x-1}$, where δ is the gray scale difference value, $L_x$ is the theoretical gray scale of the sub-pixel, $L_{x-1}$ is a theoretical gray scale of a sub-pixel in an (X−1)-th row of sub-pixels and in the same column as the sub-pixel; and determining the gray scale compensation value for the data signal provided to the sub-pixel according to the gray scale difference value and a gray scale compensation look-up table. It is understood that the actual gray scales of the data signals provided by the driver to the first row of sub-pixels are same as the theoretical gray scale values of the first row of sub-pixels (i.e., the gray scale compensation values for the data signals provided to the first row of sub-pixels are 0).

In the display panel provided by the present disclosure, before providing data signals to each of at least one row of far-end sub-pixels (e.g., at least one row of sub-pixels of second to M-th rows of sub-pixels), the driver compares a difference value between a gray scale corresponding to the data signal of each sub-pixel in the current row and a gray scale corresponding to a data signal provided to a corresponding sub-pixel (i.e., a sub-pixel in the same column as the sub-pixel in the current row) in the previous row of sub-pixels receiving the data signals, and performs gray scale compensation on the data signal provided to each sub-pixel in the current row of sub-pixels according to the difference value, so as to improve brightness uniformity of an image displayed by the display panel, eliminate a phenomenon of brightness reduction of the far-end sub-pixel caused by an influence of circuit RC on an amplitude of the data signal received by the far-end sub-pixel, and improve an image display effect of the display panel.

The structure of the driver is not particularly limited in the embodiments of the present disclosure, for example, in an embodiment, as shown in FIG. 7 and FIG. 13, the driver may include a look-up table module (LUT module) configured to determine a gray scale compensation value for the data signal provided to each sub-pixel in the X-row of sub-pixels, determine, for each sub-pixel in the X-row of sub-pixels, an actual gray scale corresponding to the sub-pixel in the X-row of sub-pixels according to the gray scale compensation value and a theoretical gray scale value of the sub-pixel in the X-row of sub-pixels, and provide the data signals to the X-th row of sub-pixels according to the actual gray scales corresponding to the respective sub-pixels in the X-row of sub-pixels. The look-up table module determines, for each sub-pixel in the X-row of sub-pixels, the gray scale compensation value for the data signal provided to the sub-pixel by: calculating a gray scale difference value by the formula $\delta=L_x-L_{x-1}$, where $\delta$ is the gray scale difference value, $L_x$ is the theoretical gray scale of the sub-pixel in the X-th row of sub-pixels, $L_{x-1}$ is a theoretical gray scale of a sub-pixel in an (X−1)-th row of sub-pixels and in the same column as the sub-pixel in the X-row of sub-pixels, X is a variable and is a natural number greater than 1 and less than or equal to M; and determining the gray scale compensation value for the data signal provided to the sub-pixel in the X-th row of sub-pixels according to the gray scale difference value and the gray scale compensation look-up table.

In order to further improve the brightness uniformity of the image displayed by the display panel, in some embodiments, the driver is configured to provide data signals to the M-th row of sub-pixels in a duration longer than a duration for providing data signals to the first row of sub-pixels, and provide data signals to a K-th row of sub-pixels in a duration not less than a duration for providing data signals to an N-th row of sub-pixels, where, and N and K are any two integers, and M>K>N>1.

In the display panel provided by the present disclosure, the duration for the driver to provide the data signal to the far-end sub-pixel is longer than the duration for the driver to provide the data signal to the near-end sub-pixel, so that the charging time of the far-end sub-pixel is prolonged, the charging rates of the far-end sub-pixel and the near-end sub-pixel are ensured to be consistent, the reduction of the brightness of the far-end sub-pixel caused by the influence of circuit RC on the amplitude of the data signal received by the far-end sub-pixel is avoided, and further the brightness uniformity of the image displayed by the display panel is improved.

It should be noted that, the duration in which the driver provides the data signals to each row of sub-pixels has the following principle: the duration for providing data signals to a row of near-end pixels is shortened, and the duration for providing data signals to a row of far-end sub-pixels is prolonged, and the sum of the prolonged time is equal to the sum of the shortened time. For example, in some embodiments, the duration for providing data signals by the driver to each row of sub-pixels is gradually increased from the first row of sub-pixels to the M-th row of sub-pixels, and the charging time of each row of sub-pixels is gradually increased from near to far in a gradual change mode, as shown in FIG. 5.

In other embodiments, to avoid the excessive adjustment of the charging time of the near-end sub-pixels and the far-end sub-pixels, the duration for providing data signals by the driver to each row of sub-pixels is the same from the first row of sub-pixels to the O-th row of sub-pixels, the duration for providing data signals by the driver to each row of sub-pixels is the same from the Y-th row of sub-pixels to the M-th row of sub-pixels, the duration for providing data signals by the driver to each row of sub-pixels is gradually increased from the O-th row of sub-pixels to the Y-th row of sub-pixels, where 1<O<Y<M, and O and Y are integers. That is, in the embodiment of the present disclosure, the charging time is gradually compensated for only in the middle area of the display panel, and the charging time of each of multiple rows of sub-pixels is the same in the area close to the edge of the display panel, so as to avoid the edge of the display panel from being too bright or too dark, and improve the display effect.

In some embodiments, the driver includes a data buffer (line buffer) for storing the data signals, the driver is configured to determine a difference T2−T1 between the duration for providing the data signals to the M-th row of sub-pixels and the duration for providing the data signals to the first row of sub-pixels according to a calculation formula of T2−T1=L1×H/H1, and determine the duration for providing the data signals to the M-th row of sub-pixels according to the difference of T2−T1, where T2 is the duration for providing the data signals to the M-th row of sub-pixels (which may correspond to t2 in FIG. 9), T1 is the duration for providing the data signals to the first row of sub-pixels (which may correspond to t1 in FIG. 9), H is an average of the durations for providing the data signals to respective rows of sub-pixels by the driver, H1 is the number of rows of sub-pixels to be compensated, L1 is the total number of rows of sub-pixels buffered by the data buffer, H=1/(f×M), and f is a refresh rate of the display panel.

In some embodiments, the interface transmission rate of the driver needs to be increased by F1 compared with the interface transmission rate of the existing driver, and F1=1/(H−T2+T1).

As a third aspect of the present disclosure, there is also provided a display device including the display panel provided in the foregoing embodiments.

The type of the display device is not particularly limited in the embodiments of the present disclosure, and for example, the display device may be a television, a mobile phone, a tablet computer, a notebook computer, a smart watch, or the like.

It will be understood that the above embodiments are merely exemplary embodiments employed to illustrate the principles of the present disclosure, and the present disclosure is not limited thereto. It will be apparent to those skilled in the art that various changes and modifications can be made without departing from the spirit and scope of the present disclosure, and these changes and modifications are to be considered within the scope of the present disclosure.

What is claimed is:

1. A method for driving a display panel having M rows of sub-pixels, applied to a driver of the display panel, comprising:

providing data signals to the M rows of sub-pixels, wherein providing data signals to an X-th row of sub-pixels in the M rows of sub-pixels comprises:

determining, for each sub-pixel in the X-th row of sub-pixels, a gray scale compensation value for a data signal provided to the sub-pixel in the X-th row of sub-pixels;

determining, for each sub-pixel in the X-th row of sub-pixels, an actual gray scale corresponding to the sub-pixel in the X-th row of sub-pixels according to the gray scale compensation value and a theoretical gray scale value of the sub-pixel in the X-th row of sub-pixels; and providing the data signals to the X-th row of sub-pixels according to the actual gray scales corresponding to the respective sub-pixels in the X-th row of sub-pixels;

wherein for each sub-pixel in the X-th row of sub-pixels, the gray scale compensation value for the data signal provided to the sub-pixel is determined by:

calculating a gray scale difference value by a formula of $\delta=L_x-L_{x-1}$, where $\delta$ is the gray scale difference value, $L_x$ is the theoretical gray scale of the sub-pixel in X-th row of sub-pixels, $L_{x-1}$ is a theoretical gray scale of a sub-pixel in an (X−1)-th row of sub-pixels and in the same column as the sub-pixel in the X-th row of sub-pixels, X is a variable, and M and X are natural numbers, and $M \geq X > 1$; and determining the gray scale compensation value for the data signal provided to the sub-pixel in the X-th row of sub-pixels according to the gray scale difference value and a gray scale compensation look-up table.

2. The method of claim 1, wherein the driver is configured to provide the data signals to the M rows of sub-pixels, a first row of sub-pixels is closest to the driver, and the step of providing the data signals to the M rows of sub-pixels satisfies the following condition:

a duration for providing data signals to an M-th row of sub-pixels is longer than a duration for providing data signals to the first row of sub-pixels, and a duration for providing data signals to a K-th row of sub-pixels is not less than a duration for providing data signals to an N-th row of sub-pixels, where N and K are integers, and $M>K>N>1$.

3. The method of claim 2, wherein the display panel comprises a data line multiplexing circuit, a plurality of scan lines, and a plurality of data lines, the plurality of data lines are in one-to-one correspondence with a plurality of columns of sub-pixels, the driver comprises a plurality of driving terminals configured to provide the data signals and each of the plurality of driving terminals corresponds to L data lines of the plurality of data lines, the data line multiplexing circuit comprises L data selection signal terminals, and L is a positive integer greater than 2;

the step of providing the data signals to the X-th row of sub-pixels according to the actual gray scales corresponding to the respective sub-pixels in the X-th row of sub-pixels comprises:

providing effective data selection signals to the L data selection signal terminals in sequence to control the data line multiplexing circuit to cause each driving terminal of the plurality driving terminals to be electrically coupled with the L data lines corresponding to the driving terminal in sequence;

wherein a duration of an effective level of a data selection signal when providing the data signals to the M-th row of subpixels is longer than a duration of an effective level of a data selection signal when providing the data signals to the first row of sub-pixels, and a duration of an effective level of a data selection signal when providing the data signals to the K-th row of sub-pixels is not less than a duration of an effective level of a data selection signal when providing the data signals to the N-th row of sub-pixels.

4. The method of claim 3, wherein the data line multiplexing circuit comprises a plurality of multiplexing modules and L data selection signal lines, each of the plurality of multiplexing modules has one input terminal, L multiplexing control terminals, and L output terminals, the input terminal is coupled to a corresponding driving terminal of the driver, the L output terminals are respectively coupled to L data lines corresponding to the corresponding driving terminal, the L multiplexing control terminals of the multiplexing module are respectively coupled to the L data selection signal terminals of the data line multiplexing circuit through the L data selection signal lines, the multiplexing module is capable of electrically coupling the input terminal with a corresponding output terminal upon receipt of an effective data selection signal at each of the plurality of multiplexing control terminals; and the step of providing the data signals to the X-th row of sub-pixels according to the actual gray scales corresponding to the respective sub-pixels in the X-th row of sub-pixels comprises:

providing the effective data selection signals to the L data selection signal terminals in sequence to control each of the plurality of multiplexing modules to cause a corresponding driving terminal to be electrically coupled with the L data lines corresponding to the corresponding driving terminal in sequence.

5. The method of claim 4, wherein each of the plurality of multiplexing modules comprises L switch transistors, first electrodes of the L switch transistors are all coupled to the input terminal, control electrodes of the L switch transistors are respectively coupled to the L data selection signal lines, and second electrodes of the L switch transistors are respectively coupled to the L data lines in a one-to-one correspondence manner.

6. The method of claim 2, wherein the step of providing the data signals to the M rows of sub-pixels further satisfies the following condition:

a duration for providing data signals to each row of sub-pixels is the same from the first row of sub-pixels to an O-th row of sub-pixels, a duration for providing data signals to each row of sub-pixels is the same from a Y-th row of sub-pixels to the M-th row of sub-pixels, and a duration for providing data signals to each row of sub-pixels is gradually increased from the O-th row of sub-pixels to the Y-th row of sub-pixels, where O and Y are integers and $1<O<Y<M$.

7. The method of claim 2, wherein the step of providing the data signals to the M rows of sub-pixels further satisfies the following condition:

a duration for providing data signals to each row of sub-pixels is gradually increased from the first row of sub-pixels to the M-th row of sub-pixels.

8. The method of claim 2, wherein the driver comprises a data buffer for storing data signals, and the duration for providing the data signals to the M-th row of sub-pixels is determined by:

determining a difference of T2−T1 between the duration for providing the data signals to the M-th row of sub-pixels and the duration for providing the data signals to the first row of sub-pixels according to a calculation formula of T2−T1=L1×H/H1, where T2 is the duration for providing the data signals to the M-th row of sub-pixels, T1 is the duration for providing the data signals to the first row of sub-pixels, H is an average of durations for providing data signals to respective rows of sub-pixels by the driver, H1 is a number of rows of sub-pixels to be compensated, L1 is a total number of rows of sub-pixels buffered by the data buffer, H=1/(f×M), and f is a refresh rate of the display panel; and determining the duration for providing the data signals to the M-th row of sub-pixels according to the difference of T2−T1.

9. The method of claim 2, wherein providing data signals to the first row of sub-pixels comprises: providing the data signals to the first row of sub-pixels according to theoretical gray scale values corresponding to respective sub-pixels in the first row of sub-pixels.

10. A display panel, comprising M rows of sub-pixels and a driver configured to provide data signals to the M rows of sub-pixels, wherein the driver is configured to implement the method of claim 1.

11. The display panel of claim 10, wherein the driver comprises a look-up table module configured to: determine, for each sub-pixel in the X-th row of sub-pixels, the gray scale compensation value for the data signal provided to the sub-pixel in the X-th row of sub-pixels, determine, for each sub-pixel in the X-th row of sub-pixels, the actual gray scale corresponding to the sub-pixel in the X-th row of sub-pixels according to the gray scale compensation value and the theoretical gray scale value of the sub-pixel in the X-th row of sub-pixels, and provide the data signals to the X-th row of sub-pixels according to the actual gray scales corresponding to the respective sub-pixels in the X-th row of sub-pixels, wherein for each sub-pixel in the X-th row of sub-pixels, the gray scale compensation value for the data signal provided to the sub-pixel is determined by:

calculating the gray scale difference value by the formula of $\delta=L_x-L_{x-1}$, where δ is the gray scale difference value, $L_x$ is the theoretical gray scale of the sub-pixel in the X-th row of sub-pixels, $L_{x-1}$ is the theoretical gray scale of a sub-pixel in the (X−1)-th row of sub-pixels and in the same column as the sub-pixel in the X-th row of sub-pixels, X is a variable and is a natural number greater than 1 but less than or equal to M; and determining the gray scale compensation value for the data signal provided to the sub-pixel in the X-th row of sub-pixels according to the gray scale difference value and the gray scale compensation look-up table.

12. The display panel of claim 10, wherein a first row of sub-pixels is closest to the driver, and the driver is configured such that a duration for providing data signals to an M-th row of sub-pixels is longer than a duration for providing data signals to the first row of sub-pixels, and for an N-th row of sub-pixels and a K-th row of sub-pixels, a duration for providing data signals to the K-th row of sub-pixels is not less than a duration for providing data signals to the N-th row of sub-pixels, where N and K are integers, and M>K>N>1.

13. The display panel of claim 12, wherein the driver is configured such that a duration for providing data signals to each row of sub-pixels is the same from the first row of sub-pixels to an (O−1)-th row of sub-pixels, a duration for providing data signals to each row of sub-pixels is the same from a Y-th row of sub-pixels to the M-th row of sub-pixels, and a duration for providing data signals to each row of sub-pixels is gradually increased from the O-th row of sub-pixels to the Y-th row of sub-pixels, where O and Y are integers, and 1<O<Y<M.

14. The display panel of claim 12, wherein the driver is configured such that a duration for providing data signals to each row of sub-pixels is gradually increased from the first row of sub-pixels to the M-th row of sub-pixels.

15. The display panel of claim 10, wherein the display panel comprises a data line multiplexing circuit, a plurality of scan lines, and a plurality of data lines, the plurality of data lines are in one-to-one correspondence with a plurality of columns of sub-pixels, the driver comprises a plurality of driving terminals configured to provide the data signals and each of the plurality of driving terminals corresponds to L data lines of the plurality of data lines, the data line multiplexing circuit comprises L data selection signal terminals, and L is a positive integer greater than 2.

16. The display panel of claim 15, wherein the data line multiplexing circuit comprises a plurality of multiplexing modules and L data selection signal lines, each of the plurality of multiplexing modules has one input terminal, L multiplexing control terminals, and L output terminals, the input terminal is coupled to a corresponding driving terminal of the driver, the L output terminals are respectively coupled to L data lines corresponding to the corresponding driving terminal, the L multiplexing control terminals of the multiplexing module are respectively coupled to the L data selection signal terminals of the data line multiplexing circuit through the L data selection signal lines, the multiplexing module is capable of electrically coupling the input terminal with a corresponding output terminal upon receipt of an effective data selection signal at each of the plurality of multiplexing control terminals.

17. The display panel of claim 16, wherein each of the plurality of multiplexing modules comprises L switch transistors, first electrodes of the L switch transistors are all coupled to the input terminal, control electrodes of the L switch transistors are respectively coupled to the L data selection signal lines, and second electrodes of the L switch transistors are respectively coupled to the L data lines in a one-to-one correspondence manner.

18. The display panel of claim 10, wherein the driver comprises a data buffer for storing data signals, and the driver is further configured to: determine a difference of T2−T1 between the duration for providing the data signals to the M-th row of sub-pixels and the duration for providing the data signals to the first row of sub-pixels according to a calculation formula of T2−T1=L1×H/H1, and determine the duration for providing the data signals to the M-th row of sub-pixels according to the difference of T2−T1, where T2 is the duration for providing the data signals to the M-th row of sub-pixels, T1 is the duration for providing the data signals to the first row of sub-pixels, H is an average of durations for providing data signals to the respective rows of sub-pixels by the driver, H1 is a number of rows of sub-pixels to be compensated, L1 is a total number of rows of sub-pixels buffered by the data buffer, $H=1/(f\times M)$, and f is a refresh rate of the display panel.

19. A display device, comprising the display panel of claim 10.

* * * * *